US007168974B2

(12) United States Patent
Feldman et al.

(10) Patent No.: US 7,168,974 B2
(45) Date of Patent: Jan. 30, 2007

(54) THREE PHASE LIGHTED PLUGS AND CONNECTORS FOR INDICATING THE ABSENCE OF AT LEAST ONE PHASE

(75) Inventors: Steven Feldman, New York, NY (US); David P. Eckel, Eaton's Neck, NY (US); Maxim Laurent, Brooklyn, NY (US); Gaetano Bonasia, Bronx, NY (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 0 days.

(21) Appl. No.: 11/094,161

(22) Filed: Mar. 31, 2005

(65) Prior Publication Data

US 2006/0057890 A1 Mar. 16, 2006

Related U.S. Application Data

(60) Provisional application No. 60/560,445, filed on Apr. 8, 2004.

(51) Int. Cl.
*H01R 3/00* (2006.01)

(52) U.S. Cl. ..... 439/488

(58) Field of Classification Search ..... 439/488, 439/489, 490; 361/76
See application file for complete search history.

(56) References Cited

U.S. PATENT DOCUMENTS 2,428,563 A * 10/1947 Fountain ..... 340/651
2,660,717 A * 11/1953 Hood ..... 340/651
2,698,879 A * 1/1955 O'D Shepherd ..... 379/244
3,007,105 A * 10/1961 Klokow et al. ..... 322/36
3,778,801 A * 12/1973 Nudelmont ..... 340/654
3,848,160 A * 11/1974 Boothman et al. ..... 361/76
4,345,477 A * 8/1982 Johnson ..... 73/766
5,297,015 A * 3/1994 Miyazaki et al. ..... 363/146
5,699,051 A * 12/1997 Billig et al. ..... 340/657
6,746,250 B2 * 6/2004 Blutbacher ..... 439/34
2006/0040546 A1 * 2/2006 Werthman et al. ..... 439/488

* cited by examiner

*Primary Examiner*—Chandrika Prasad
(74) *Attorney, Agent, or Firm*—Paul J. Sutton

(57) ABSTRACT

Indicator means located in a plug or connector indicates when at least one phase of an AC multi-phase voltage is absent. The indicator means can be any one of a variety of light sources and/or an audible generator. The light source can be, for example, an LED, an illuminating ring visible from any angle around the body of the plug or connector, etc. An opaque barrier can be used to totally or partially block the light from the light source when light from the light indicator may be objectionable such as during a stage lighting application. The indicator means for detecting the absence of at least one phase can be on a printed circuit board connected to receive power from the conductors in the plug or connector.

13 Claims, 16 Drawing Sheets

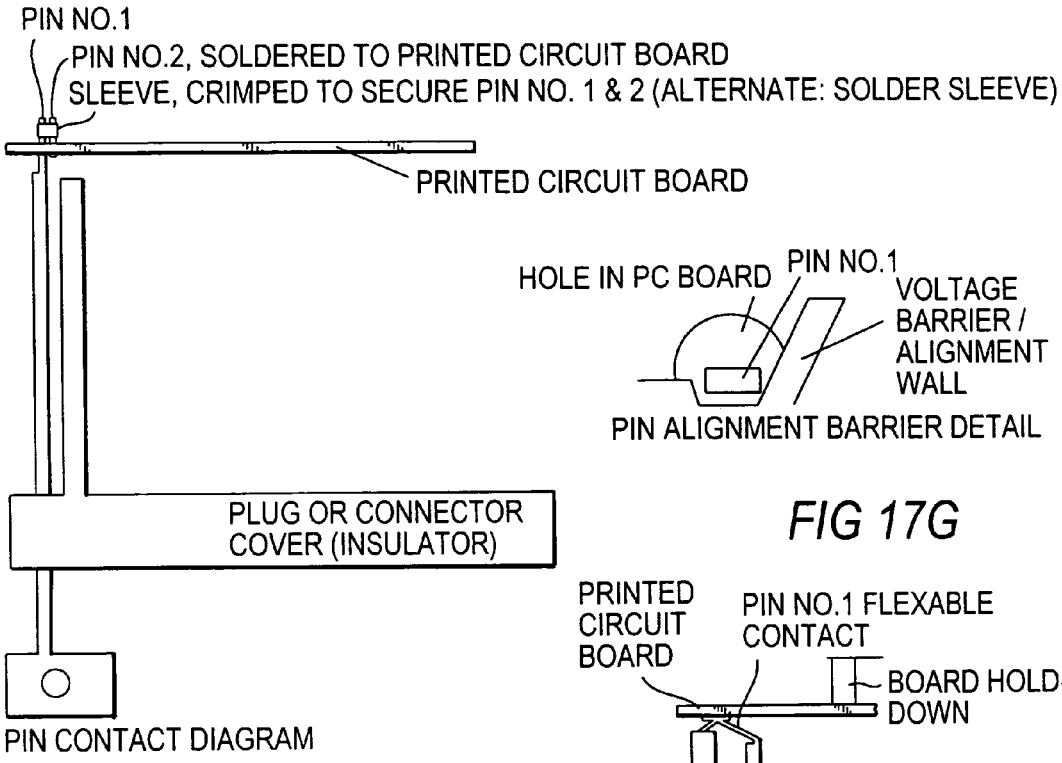
FIG 17A
FIG 17G
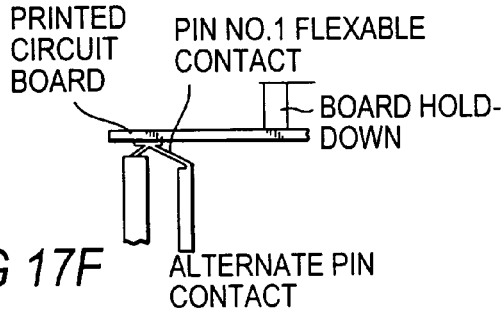
FIG 17F
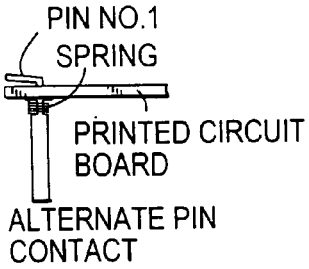
FIG 17B
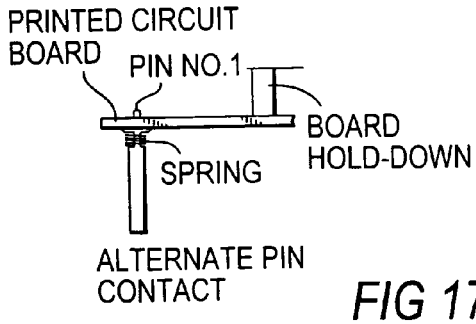
FIG 17C
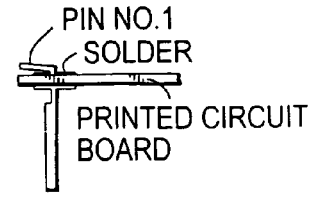
FIG 17D
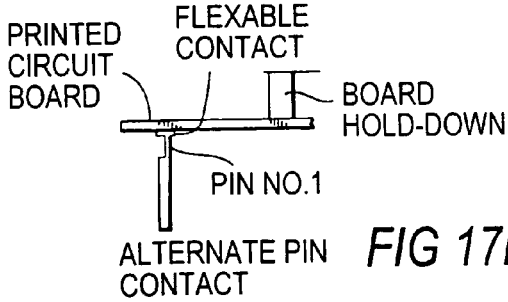
FIG 17E

| | PHASE | | | W Sys. Gnd | G Equ. Gnd | Lamp State |
|---|---|---|---|---|---|---|
| No. | X | Y | Z | | | |
| 1 | X | X | X | X | | ON |
| 2 | | X | X | X | | ON |
| 3 | X | X | | X | | ON |
| 4 | X | | X | X | | ON |
| 5 | X | | | X | | ON |
| 6 | | X | | X | | ON |
| 7 | | | X | X | | ON |
| 8 | | | | X | | OFF |
| 9 | X | X | X | | X | ON |
| 10 | | X | X | | X | ON |
| 11 | X | X | | | X | ON |
| 12 | X | | X | | X | ON |
| 13 | X | | | | X | ON |
| 14 | | X | | | X | ON |
| 15 | | | X | | X | ON |
| 16 | | | | | X | OFF |
| 17 | X | X | X | | | ON |
| 18 | | X | X | | | ON |
| 19 | X | X | | | | ON |
| 20 | X | | X | | | ON |
| 21 | X | | | | | OFF |
| 22 | | X | | | | OFF |
| 23 | | | X | | | OFF |
| 24 | | | | | | OFF |

FIG. 32

THREE PHASE LIGHTED PLUGS AND CONNECTORS FOR INDICATING THE ABSENCE OF AT LEAST ONE PHASE

CROSS-REFERENCE TO RELATED APPLICATION

The application claims priority pursuant to 35 U.S.C. 119(e) from U.S. Provisional Patent Application having application Ser. No. 60/560,445, filed Apr. 8, 2004.

BACKGROUND OF THE INVENTION

1. Field of the Invention

This invention relates generally to electrical plugs and/or connectors and more particularly to indicating if a phase of an AC power plug or connector is missing.

2. Background of the Invention

Extension cords having a plug at one end and a connector at the other end of an insulated cable having conductors sized to carry a maximum current, are typically used both indoors and outdoors. When used as a general purpose conductor, the extension cord may be used to supply power to a power tool, a window mounted air conditioner, a mobile home etc. When used for a specific purpose such as for an industrial application, it may be used to supply power, on a temporary of semi-temporary basis to a motor for driving industrial equipment welding equipment, etc.

Two phases are frequently used for large domestic appliances such as cooking ranges, water heaters, etc. These can be either split phase (from a center tapped transformer or two phases from a three-phase system. Industrial connectors normally use three-phase rather than single phase electrical power. Such multi-phase systems have several advantages in that they provide a better ratio of cable diameter to maximum voltage, allow for greater voltage on trunk lines than is fed to single phase appliances, although split phase can also achieve this, and permit large motors to operate more efficiently. When the current is supplied via an extension cord, the plug and connector of the extension cord can have two or three separate phase terminals plus an earth terminal and, in some cases, a neutral terminal for a total of five terminals. In some instances, plugs and connectors with two live terminals and a neutral may also be used. Almost all three phase power plugs and connectors have an earth or "ground" connection, but may not have a neutral terminal because large appliances such as circular saws and air conditioners are usually connected to a delta source of power. Such delta connected plugs and connectors have only four terminals, an earth terminal, and X, Y and Z phase terminals. An example of a connector having a neutral terminal is a 30 amp and 20 amp plug which has five pins; an earth, a neutral, and X, Y, and Z phase pins.

Prior to connecting an electrical load such as a three phase motor to a source of electricity, it is important that the user be aware if one or more of the phases is absent. For example, a three phase motor will run when one of the three phases is not present. However when this happens, the currents in the two remaining phase conductors will operate the motor, but they will increase to the point where the motor may be damaged or dangerous overheating may occur. What is needed is an AC power phase detector located in a plug and/or connector which can indicate to a user when one or more phases of a three phase Delta or Wye power supply is absent.

SUMMARY OF THE INVENTION

The present invention relates to method and apparatus for indicating that the line terminals of each phase of a plug and/or connector, such as a three phase plug and/or connector, is connected to a live source of power. Although single phase plugs and connectors are available with AC power on indicators, three phase plugs and/or connectors do not have an indicator means such as a light source to indicate that each terminal of the plug or connector is connected to a live phase.

In this invention, an indicator means located in a plug or connector indicates when at least one of the terminals of a plug and/or connector of a multi-phase voltage is not connected to a live source of power. The indicator means can be any one of a variety of light sources and/or an audible indicator. The light source can be, for example, a standard LED, an illuminating ring which is visible from any angle around the body of the plug or connector, etc. For various light sources, an opaque barrier can be used to totally or partially block the light from the light source when light from the light indicator may be objectionable such as during stage lighting applications. The indicator means for detecting the absence of at least one phase can be on a printed circuit board connected to receive power from the wiring in the plug and/or connector.

Various methods can be used to supply power to the printed circuit board such as pressing conductive pins onto the edges of standard wiring terminals during assembly where mechanical keying can be used to ensure precise alignment. When no neutral conductor is present, the equipment grounding conductor can be used. To provide for remote monitoring and control, a communication protocol can be incorporated into the plug and/or connector. The printed circuit board including the circuit for indicating the absence of a phase and the indicator means is of a size which fits within the volumetric constraints of the plug and/or connector. Embodiments of the invention can be designed to operate with any variation of 1, 2, 3 or 4 pole and 2, 3, 4 or 5 wire grounding and non-grounding circuits of various voltages. The indicator means can have at least one indicator for indicating a voltage that is less than a threshold value and/or a trigger. Adequate protection should be provided either within the plug and/or connector or with another product for protection against damp, humid and/or wet conditions. In addition, the circuit of the indicator means can be designed to limit power dissipation, temperature rise, etc. of the plug and/or connector.

A communication protocol such as X-10, CAN, LonWorks, DALI, TCP/IP, CEBUS, etc. can be included to provide additional functionality such as, for example, remote annunciation, monitor, control, setup, threshold limits, feedback, data logger, day/time stamp, etc. These functions can be contained within the plug and/or connector, or distributed through the system where each has multiple function capability, a specific function or part of a function. The annunciation function can be local, brought through the system to a central location and/or sent to a remote site via the power line, via wireless, a twisted wire pair, an e-mail or by other means. The annunciation function can be selectively turned on, off, changed or modified either locally, remotely or both.

The indicator means can be a single light source such as an LED, a Neon bulb, etc., or means which generates an audible tone. With two or three phase circuits, multiple indicators can be used to assist in identifying which phase is missing. If desired, a single indicator can be used with one, two or three phase circuits. When the single indicator is a light source, it can be located to be viewed directly through an opening in the plug and/or connector, or by using a light pipe to guide light from the indicator to an opening in the plug and/or connector. When the indicator means generates an audible tone, the tone can be directed through an opening in a the plug and/or connector.

The indicator means in the plug and/or connector can flash, display different brightness levels or have multiple or changing colors to indicate the absence of a phase. In addition, it can be used to indicate that one or more of the phases has a low and/or high voltage. The use of different colors can be implemented to show one or more missing phases, a missing system (neutral) and/or equipment (earth) ground, or their status, etc. When the plug and/or connector is used for stage lighting applications, a cover can be employed to block light from the indicator means.

If the circuit for the indicator means cannot fit within the volumetric constraints of the plug or connector, an interposing wire-in or plug-in module can be used. The module can be installed into an existing enclosure in the field or it can be assembled and installed at the place of manufacture.

The indicator means can access the conductors in a plug and/or connector by any one of several methods such as, for example, terminals that are soldered to the Printed Circuit Board (PCB) can be connected by springs, solder etc. to receive power from the blades of the plug or contacts of the connector. Rails in the plug can be used to provide alignment for connecting the blades of a plug or contacts of a connector to terminals on the PCB and barriers can be located in the body of the plug or connector to provide isolation for the electrical components. The body of the plug or connector provides a platform for mounting the electronics and protecting the electronics from unauthorized access by a user A voltage can be detected on one or more of the conductors of a multi-phase plug or connector with circuitry that either provides isolation from the AC conductors. A circuit that does not provide isolation from the AC conductors is normally the smallest structure for detecting a voltage on one or more conductors of a multi-phase plug or connector. In addition to detecting a missing phase, by modifying the circuit, an unbalanced load can be detected when there is a low system leakage current or equipment ground leakage current for a Wye or Delta connected power supply. In operation, the indicator means will be on when all of the conductors are connected to a source of power. However, if one or more of the three phases is absent, the indicator means will indicate such provided one of the three phase AC conductors and an additional conductor, such as another phase, a system or an equipment ground is present for a return.

This invention relates to detecting the absence of at least one phase of a multi-phase AC power signal on a plug or connector and can be used to protect equipment connected to receive the multi-phase power signal. For example, when one phase of a three phase circuit is absent, a user can avoid damaging a motor by not connecting an AC three-phase motor to a power supply with only two operating phases.

Although single-phase plugs and connectors are available with "AC power on" indicators, three-phase connectors and three-phase plugs used in three-phase Delta and Wye configurations do not have indicator means such as, for example, a light source to indicate that at least one phase of the AC power is not present. The invention here disclosed can be used with plugs, connectors and/or electrical panels for three or less phases (with or without system, neutral and/or equipment, earth ground), and any industrial or commercial equipment having multi-phase AC mains.

The indicator means can be a variety of light sources and/or audible indicators. The light source can be an LED or an illuminated ring visible from any angle around the body of the plug and/or connector. In cases where a light may be undesirable, such as during a performance on a stage, an opaque barrier can be employed to block the light. The indicator means can be on a printed circuit board which receives its power from the existing wiring terminals of the plug or connector. Power can be supplied to the printed circuit board (PCB) by using conductive pins pressed onto the edges of standard wiring terminals on the PCB during factory assembly where mechanical keying can be used to ensure precise alignment. Where no neutral conductor is present, the equipment grounding conductor can be used. In this case, the current would be limited to ½ ma to meet UL maximum leakage requirement. Furthermore, a communication protocol can be provided to allow for remote monitoring and control.

The foregoing has outlined, rather broadly, a preferred blending feature, for example, of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which similar elements are given similar reference numerals.

FIGS. 12–16, 17A–17G, and 18 are simplified views showing several embodiments for accessing the AC mains within a plug or connector;

FIG. 32 is the logic table.

DETAILED DESCRIPTION OF THE INVENTION

This invention relates to method and apparatus for indicating the absence of a phase on a terminal of a multi-phase plug and/or connector. The means for indicating the absence of a phase of a multi-phase AC power voltage can be located within the volumetric constraints of a multi-phase plug and/or connector or, in the alternative, on a panel to which a multi-phase plug and/or connector are mounted. The means for indicating can operate with any variation of 1, 2, 3 or 4 poles and 2, 3, 4 or 5 wire grounding and non-grounding circuits of various voltages. The means for indicating, here-in-after referred to as indicator means can have a one or more lamps and/or an audible indictor, etc., to indicate the absence of a phase voltage at a plug or connector. In addition, the indicator means can be designed to indicate power dissipation through the plug and/or connector, and/or an increase of temperature of the plug and/or connector above a pre-selected value, etc.

In place of, or in addition to a lamp, a communication protocol (X-10, CAN, LonWorks, DALI, TCP/IP, CEBUS. etc.) can be included to provide additional functionality such as remote annunciation, monitor control, setup, threshold limits, feedback, data logger, day/time stamp. etc. The circuit for providing these functions can be contained within the plug or connector, or the circuit can be located downstream of the plug or connector and have either multiple function capability, a specific function or a part of a function. For example, when annunciation is provided, it can be local, brought through a system to a central location, forward to another device or sent to a remote site via power line conductors, wireless, twisted pair, email or other means. In addition, the function can be turned on, off, changed or modified either locally, remotely or both.

In the embodiment where a single light source such as a lamp is used, the lamp can be an LED, a neon bulb, or any illuminating means. With two or three-phase circuits, multiple indicators such as, for example, multiple light sources can be used to indicate which terminal of a plug or connector has no voltage.

Figure 1:
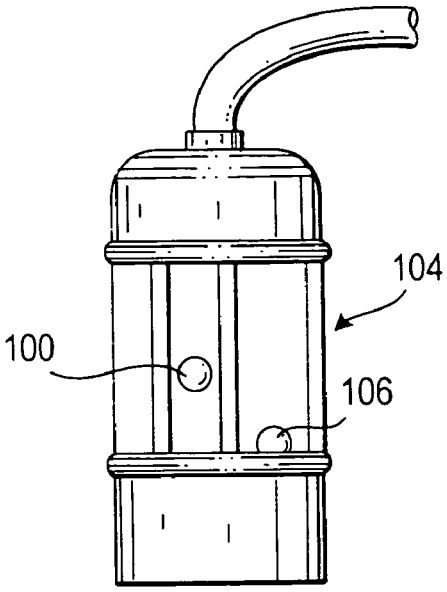
FIG. 1 is a side view of a multi-phase connector having indicator means for indicating the absence of a phase of an AC multi-phase signal.
Figure 2:
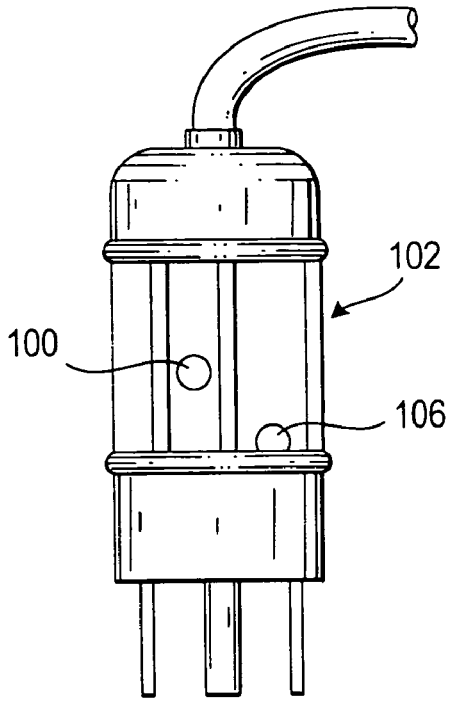
FIG. 2 is a side view of a multi-phase plug having indicator means for indicating the absence of a phase of an AC multi-phase signal.

Referring to FIGS. 1 and 2, there is shown an indicator means such as a single light source 100 for use with a multi-phase plug 102 (FIG. 2) or connector 104 (FIG. 1). The single light source 100 is located within the body of the plug or connector and aligned with an opening in the body to allow light to pass to the outside for viewing by a user. The opening can have a lens, either clear or colored, to prevent dirt from entering the body. A light pipe can be used to guide light from the light source in the plug or connector through an opening 106 for viewing by a user. Either separately or in combination with the light source, a sound generating means can be provided to alert a user to the absence of a phase.

Figure 3:
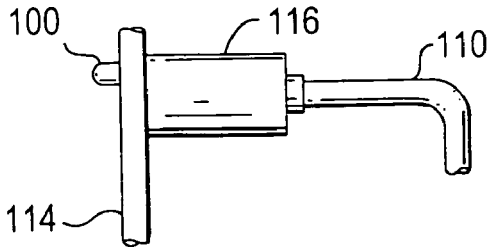
FIG. 3 is a side view of an equipment panel for an AC multi-phase power conductors having indicator means on a panel.

Referring to FIG. 3, there is shown a side view of a multi-phase connector 116 coupled to an equipment panel 114. The body of the multi-phase connector 116 projects out from the rear of panel 114 and is connected to a multi-phase conductor 110. The multi-phase connector 116 has recessed terminals which are accessed from the front of the panel by a multi-phase plug. Indicator means 100 for indicating to a user that a phase is missing is located on the front of the panel.

FIGS. 1 to 3 show a typical multi-phase plug, connector and equipment panel having an illuminating indicator means. The indicator means can be a single light source or a plurality of light sources to indicate the absence of a phase voltage. In FIGS. 1–3 the light source is positioned for viewing by a user. However, it is to be understood that the light source can be positioned to be viewed directly, or indirect by means of a light pipe, illuminating ring, etc. In those instances where light from the light source may be objectionable, such as in a theatre, a cover can be placed over the light source to partially or totally block emitted light. The light source can be positioned to light a device, product, company logo, etc., and can be located behind a clear or colored lens.

The indicator means can also included a flashing light having different brightness levels or changing colors which can be used to detect a low or high voltage for a phase. The use of different colors can be used to determine how many phases, system (neutral) and/or equipment (earth) ground are missing, their status, etc. A cover can be employed to block the illumination in certain applications, such as stage lighting, etc. If the circuitry cannot fit within the volumetric constraints of a plug or connector, an interposing wire-in or plug-in device module can be used. The wire-in device can be designed for installation in the field, or it can be designed for installation into an existing enclosure which can be assembled at the place of manufacture. Provisions can be made to replace the bulb at some time before the expiration of its expected life to avoid operating the plug, connector or equipment panel with a non-operating bulb.

Figure 4:
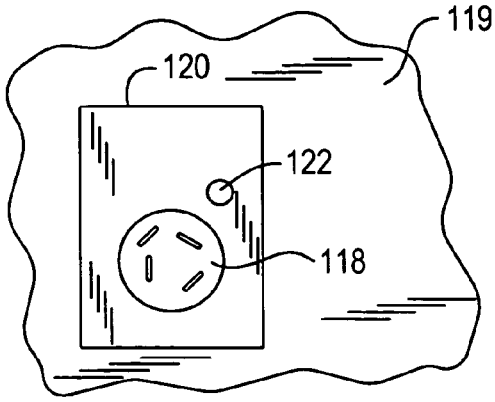
FIG. 4 is a front view of an AC multi-phase connector and an indicator means located in a wall plate.

FIG. 4 shows a multi-phase connector 118 such as a three phase connector mounted in a wall plate 120 on a wall 119. Indicator means 122, such as a light source is mounted to the wall plate and connected to circuitry which can be in the connector 118 to show the conductive state of the phases of the multi-phase connector.

Figure 5:
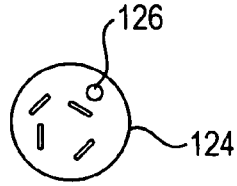
FIG. 5 is a view of a multi-phase connector with an indicator means located in an end of a connector.

FIG. 5 is a view of the end of multi-phase connector 124 where the indicator means 126 is located in the face of the connector. The connector can be an end of an extension cord, or it can be mounted in a wall plate mounted on a wall. In this embodiment, a user can see if a phase to the connector is absent before a plug is inserted into the connector.

Figure 6:
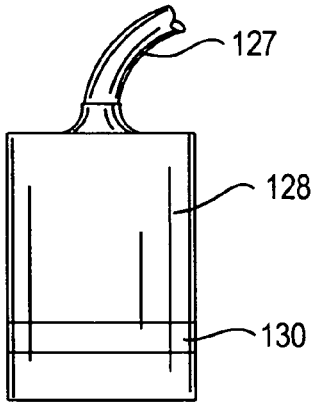
FIG. 6 is a side view of a connector where the indicator means is an illuminating ring.

FIG. 6 is a side view of a connector 128 which is connected to an end of an extension cord 127 where the indicator means 130 is an illuminating ring which partially or fully surrounds the circumference of the husk or body of the connector.

Figure 7:
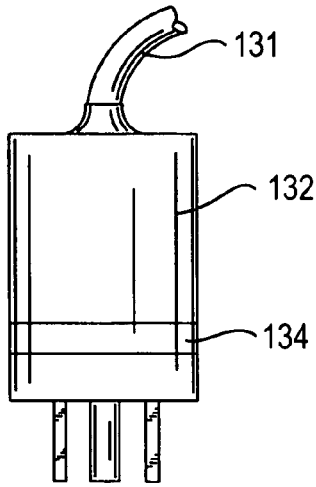
FIG. 7 is a side view of a plug where the indicator means is an illuminating ring.

FIG. 7 is a side view of a plug 132 which is at an end of an extension cord 131 where the indicator means 134 is an illuminating ring which partially or fully surrounds the circumference of the husk or body of the plug.

Figure 8:
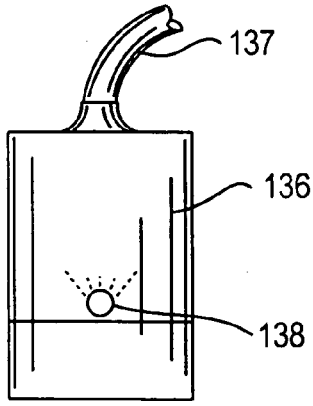
FIG. 8 is a side view of a connector where the indicator means is a light source which illuminates the body of the connector.

FIG. 8 is a side view of connector 136 located at an end of extension cord 137 where the indictor means 138 is a source of light such as an LED, etc., and where light from the LED is directed onto the husk or body of the connector. In FIG. 8, the light is shown as covering an arc of substantially 90 degrees, it being understood that the arc of light from the indicator means can be decreased or increased.

Figure 9:
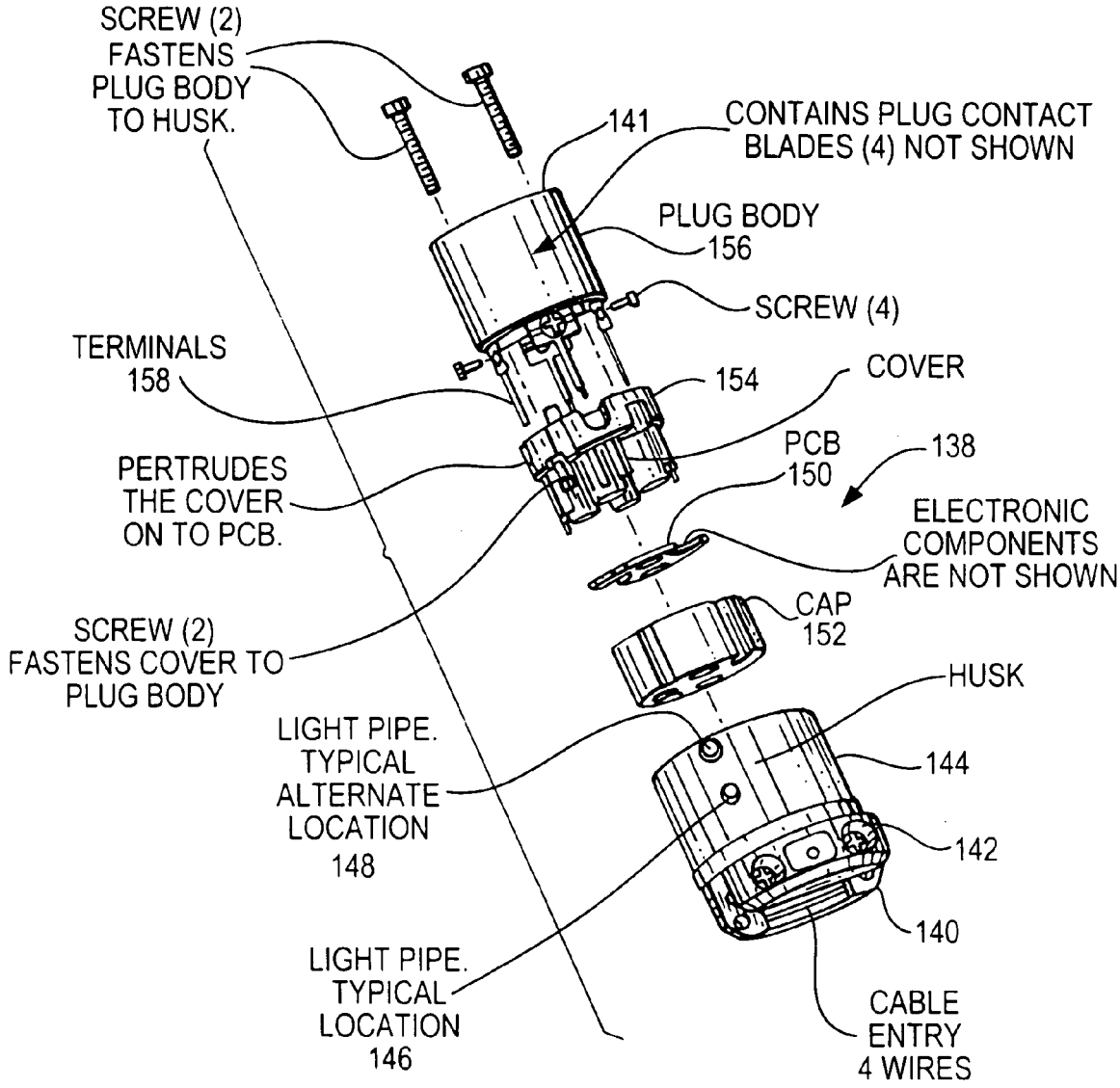
FIG. 9 is an exploded view of a connector.

Referring to FIG. 9, there is shown an exploded view of a connector 138 adapted to be connected to an end of an extension cord. The connector has a front end 141 for receiving the blades of a plug and a back end for receiving a multi-phase cable. A cable clamping member composed of insulating material consists of a sleeve 140 having a centrally located opening for receiving a cable and a clamp member 142 for clamping a cable. After a cable is inserted into the opening of the sleeve, the clamp member 142 is attached to the sleeve 140 by means of two screws to lock the cable to the cable clamping member.

The cable clamping member 142 can be made as a part of the husk 144 of the connector or separate from the husk. When member 142 is not a part of the husk, the two can be joined to form a single member by securing member 142 to husk 144 by means of a threaded connection, bonding means, etc. The husk 144 has a window 146 which can have a clear or colored lens, behind which is located a light emitting means such as an LED, a bulb etc. In those instances where it is not convenient to locate a bulb directly behind the window 146, an alternate location 148 can be selected for the window and a light positioned within the husk to direct light from the light emitting means, either directly or via a light pipe to the window 148.

Figure 10:
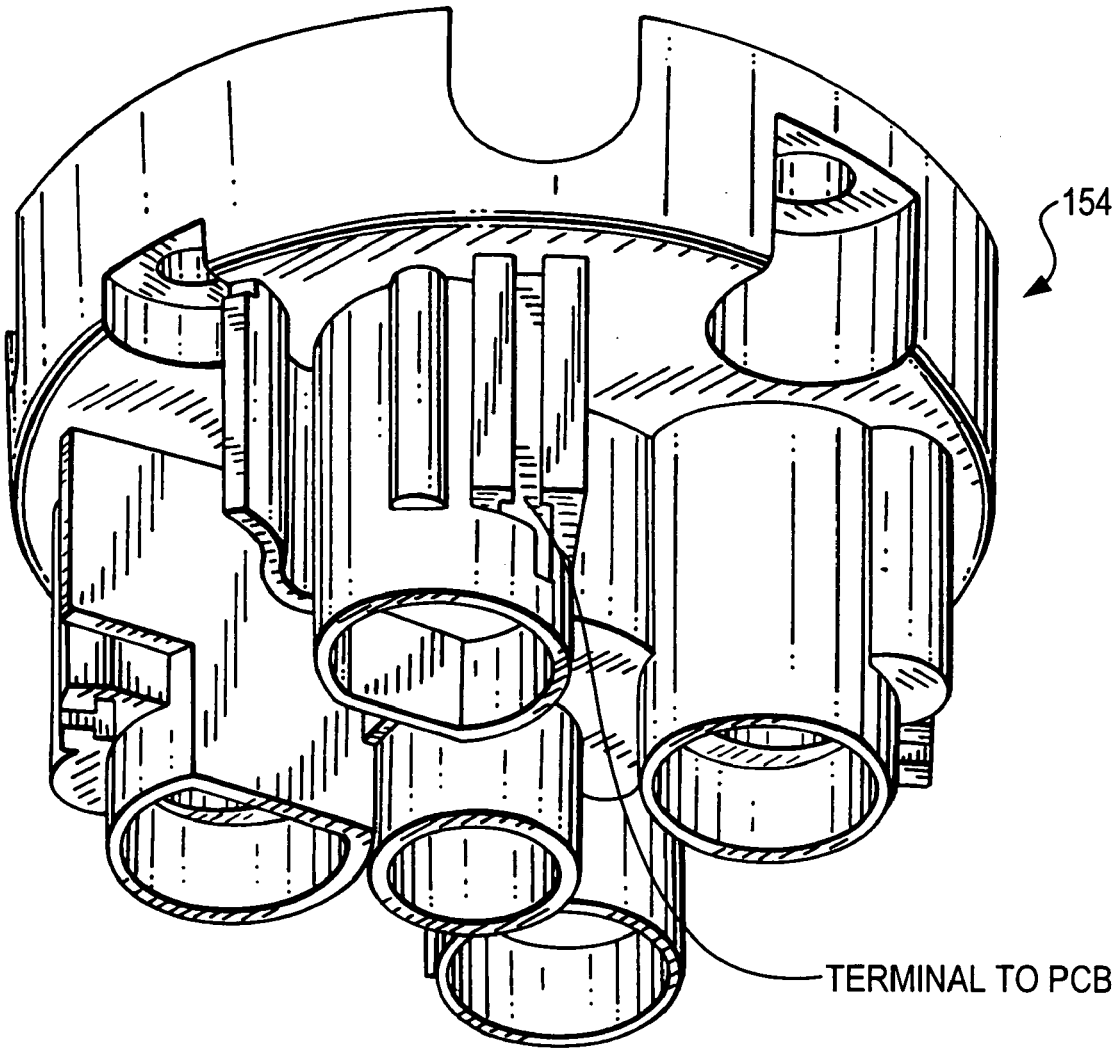
FIG. 10 is a perspective view of a cover (reference numeral 154 of FIG. 8) of a connector.
Figure 11:
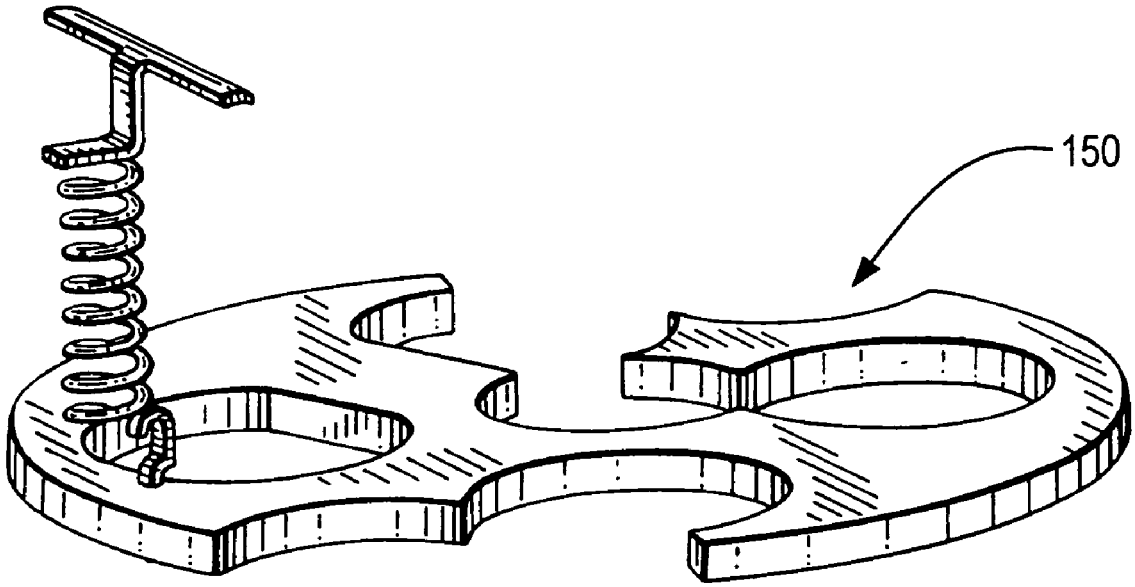
FIG. 11 is a perspective view of a printed circuit board less the indicator means and the components for the indicator means.

All of the various components of the indicator means, such as resistors, diodes, the light emitting means, the required contacts, etc. (not shown) are on Printed Circuit Board (PCB) 150. A cap 152, of non-conducting material, sized to fit within husk 144, locks the PCB 150 to a cover 154. FIG. 10 is a perspective view of a cover, and FIG. 11 is a perspective view of a Printed Circuit Board 150 having an electrical contact but no components.

The PCB 150 is configured to fit on top of cover 154 and around the cylindrical passageways in the cover 154 through which the various conductors of the cable pass to make contact with terminals and contact blades connected to the plug or connector body 156 (see FIG. 9). The conductors of the multi-phase cable are connected by means of screws to the contact blades of the plug or connector, and terminals 158 are provided to connect the various contacts on the PCB to the multi-phase conductors of the cable. Cap 152 secures the PCB and the electronics attached thereto to the cover 154 and helps prevent a user from tempering with the electronics. The plug or connector body 156 is secured to the husk 144 with two screws which locks together all the various parts of the connector to form a unitary body.

There are several methods to access the AC conductors in a plug and connector. Mechanical parts are used to insure the effectiveness of the lighted plugs and connectors under normal or extreme conditions. The terminals that are soldered onto the PCB receive power from the plug or connector blades that are held by the plug body, screw and the cover, see FIG. 9. Alternate construction, which includes springs, solder and socket methods can be used to access power from the plug or connector blades. Rails in the cover provide alignment for the terminals to the PCB. The body 156 and cover 154 secure the terminals, and the cover is riveted on the body in symmetrical or non-symmetrical locations. Barriers are also incorporated in the cover to provide isolation for the electrical components. The function of the cap 152 is to secure the electronics and prevent a user from tampering with the electronic components. All of the various parts of the plug or connector are secured within the body and the husk, which contains the light pipe that is inserted into the husk to provide operational status of the device. The light pipe can be part of the cap, cover, husk or a separate part thereof.

Referring to FIGS. 12–18, there is shown several embodiments of accessing the AC mains within a plug or connector. Mechanical parts can be used to insure the effectiveness of the lighted plugs and connectors under normal or extreme conditions. As shown in the Figs., the terminals that are soldered onto the PCB receive power form the blades that are held by the body, screw and the cover. In alternate construction, springs, solder etc., can be used to access power from the plug or connector blades. Rails in the cover provide alignment for the terminals to the PCB. The body and cover secure the terminals, and the cover is riveted to the body in symmetrical or non-symmetrical locations. Barriers can also be incorporated in the cover to provide isolation for electrical components. The cap secures the electronics and helps prevent tampering with the electronics, contacts, etc. within the plug or connector. The various parts are secured within the plug or connector husk. If a light pipe is used, it can be part of the cap, cover, husk or a separate part thereof.

Figure 12:
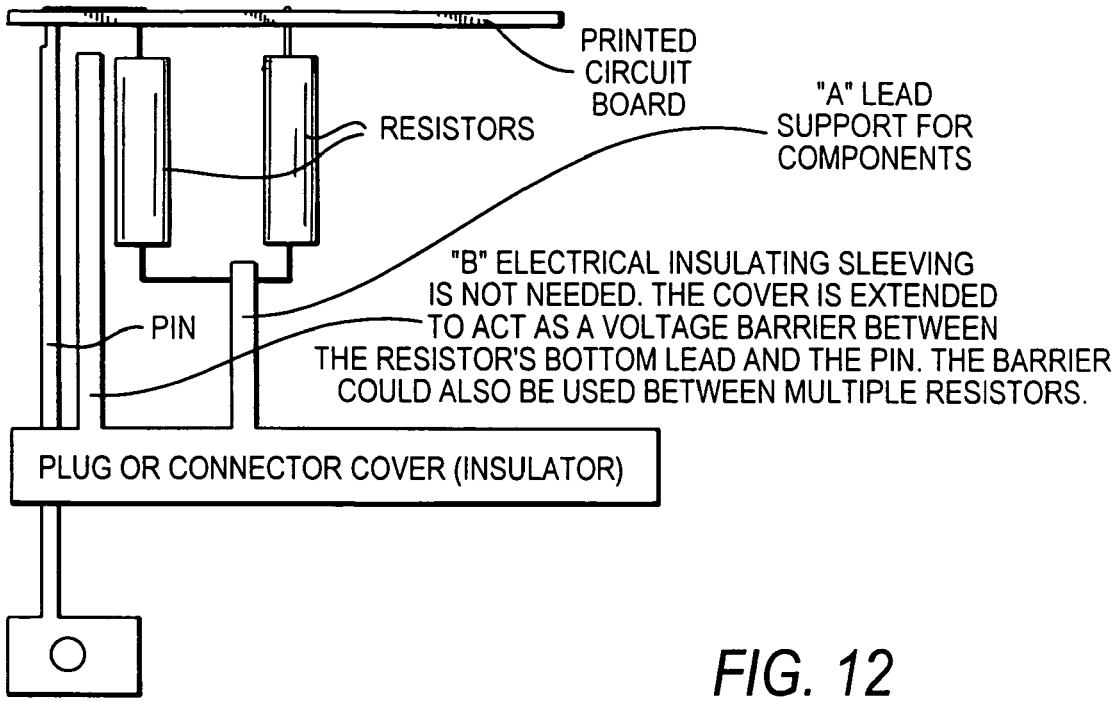
Figure 13:
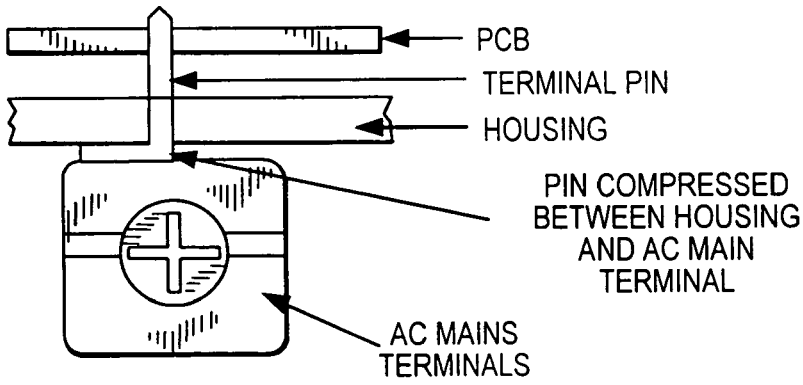
Figure 14:
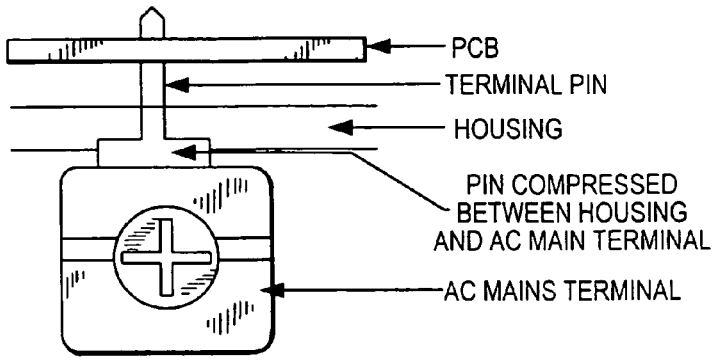
Figure 15:
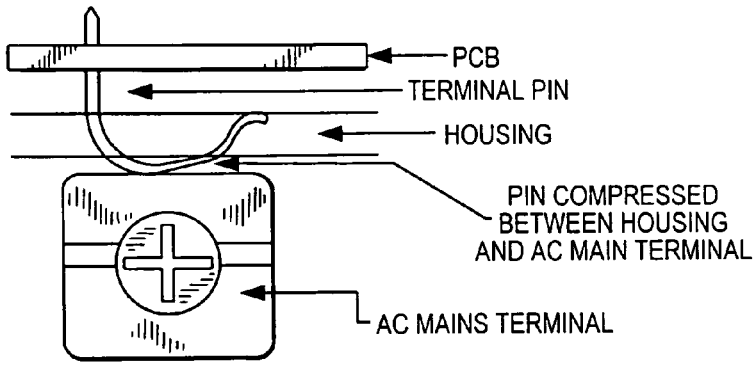
Figure 16:
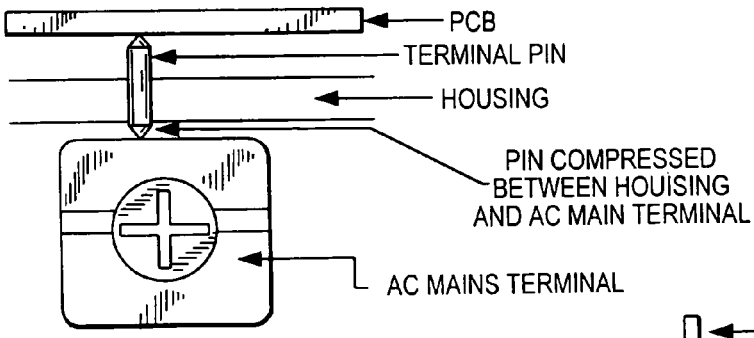
Figure 18:
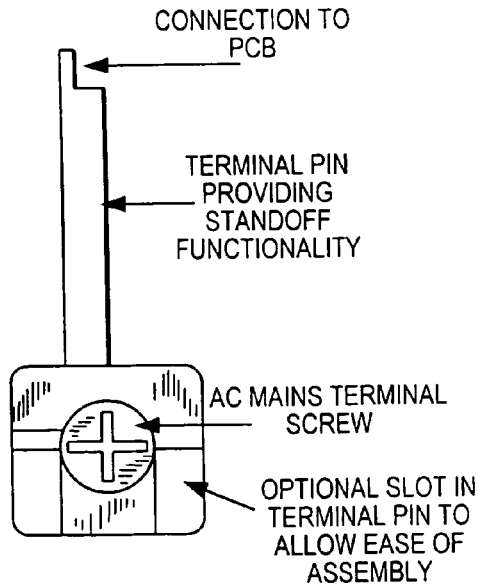

FIG. 12, illustrates terminal and voltage barrier. FIG. 13 shows an alternate terminal pin connection arrangement. FIG. 14 shows an alternate terminal pin (rivet) connection. FIG. 15 shows an alternate terminal pin (leaf spring) connection. FIG. 16 shows an alternate terminal pin (spring loaded at either one or both ends) connection. FIGS. 17A–17F show alternate pin contact embodiments, and FIG. 17G shows a pin alignment barrier embodiment. FIG. 18 shows an embodiment of a terminal pin construction.

Figure 19:
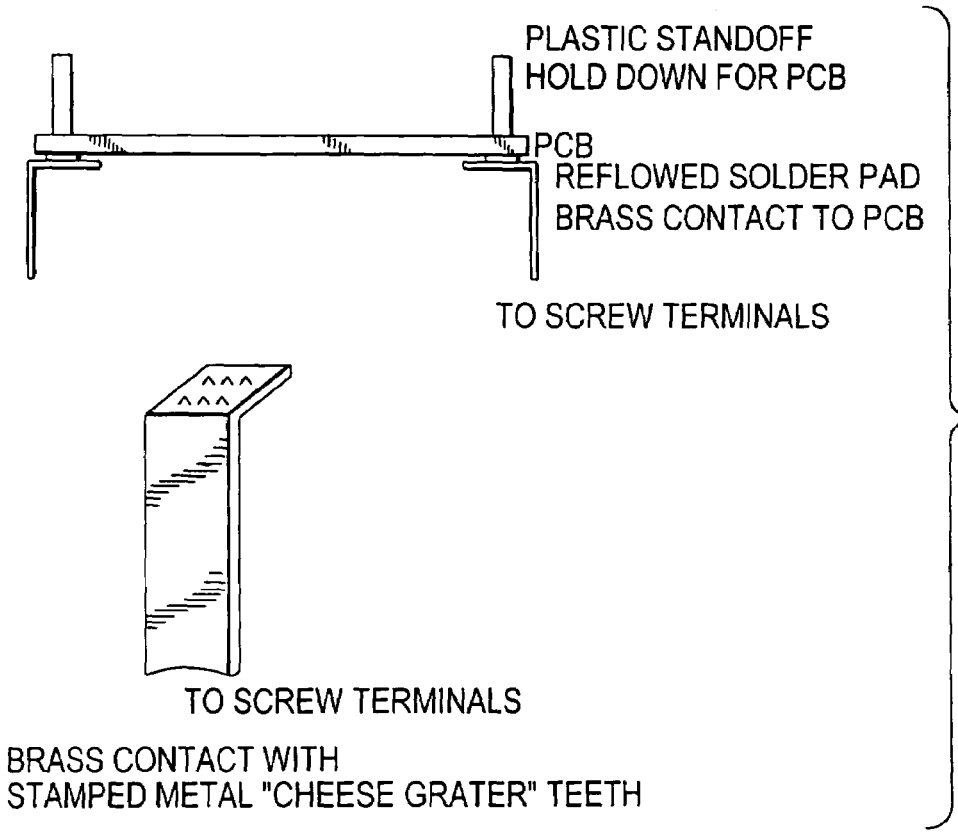
FIGS. 19 and 20 show edge contact connections to the Printed Circuit Board.
Figure 20:
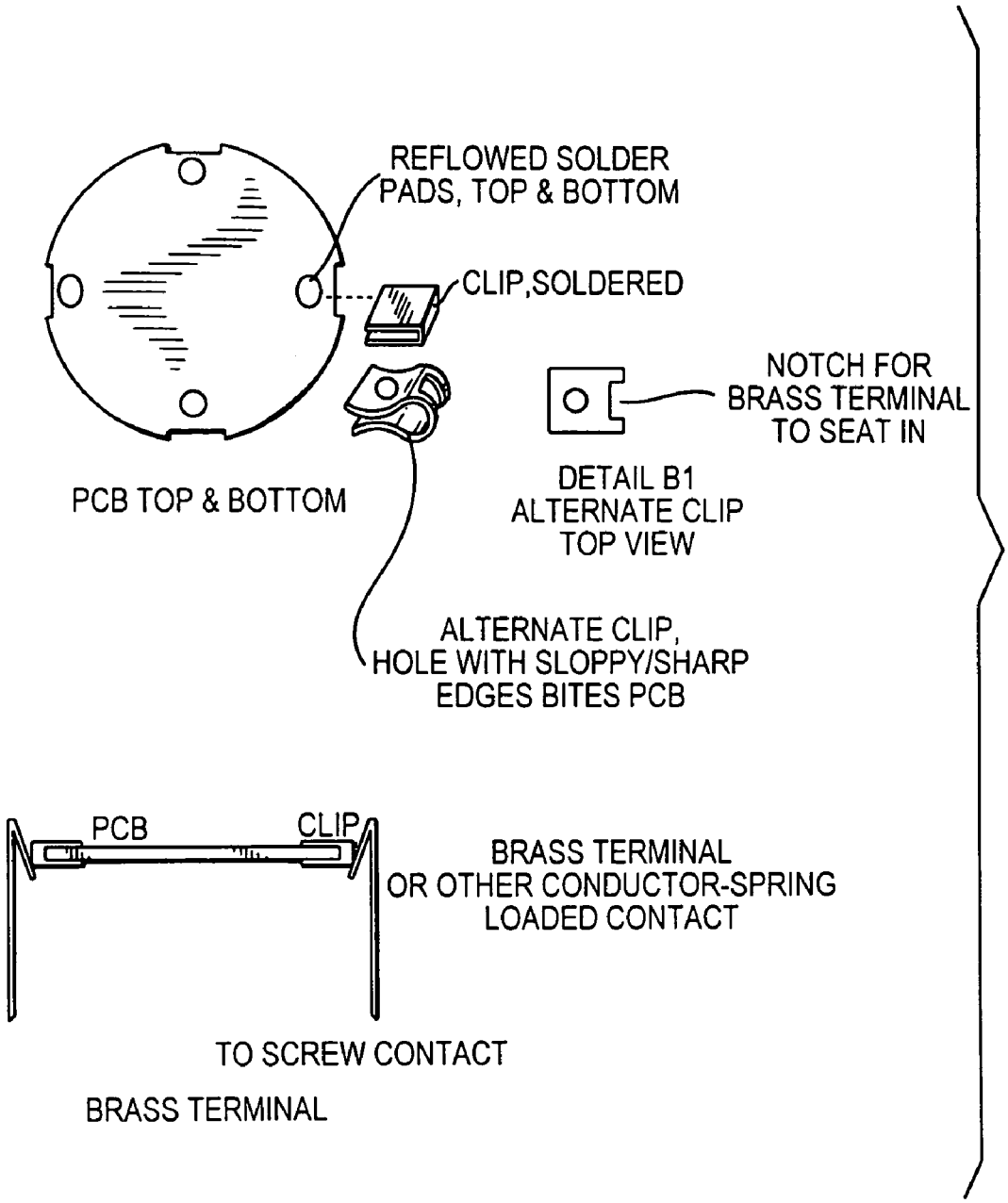

FIGS. 19 and 20 show different embodiments for making edge contact connections to the PCB. In FIG. 19, the pin or similar contact is soldered to the PCB board and also functions as a hold down mechanism. The pin is electrically connected to a screw terminal on the plug or connector. Typically, a three phase device can require four pins. FIG. 20 shows a clip in addition to the brass terminal.

Figure 21:
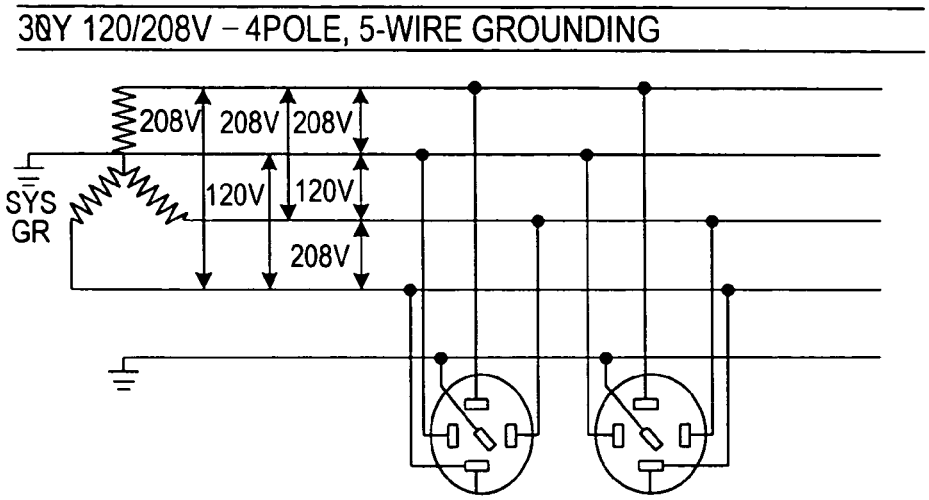
FIG. 21 shows Wye configuration with system and equipment ground.

FIG. 21, shows a Wye connection with equipment ground for a 3 phase 120/208; 4 pole, 5 wire ground connection.

Figure 22:
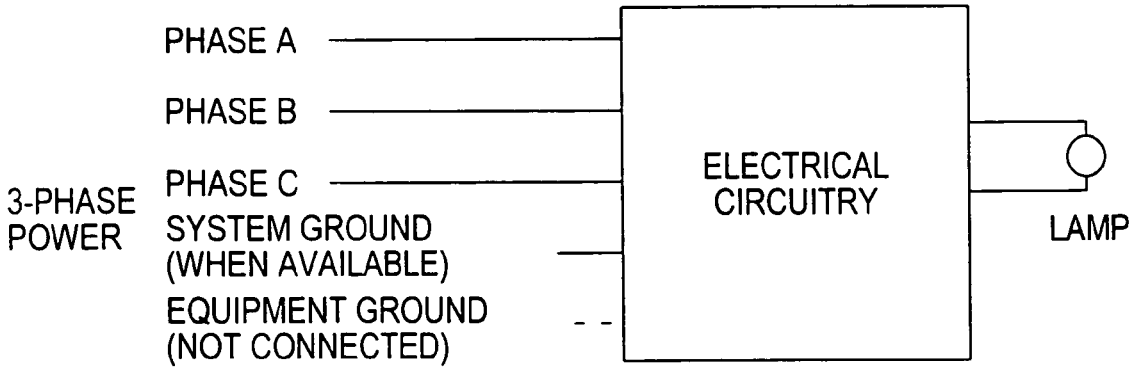
FIG. 22 shows non-isolated block diagram.

FIG. 22 shows a block diagram of a non-isolated 3 phase connection where the equipment ground is not connected and the system ground, when available, is connected.

Figure 23:
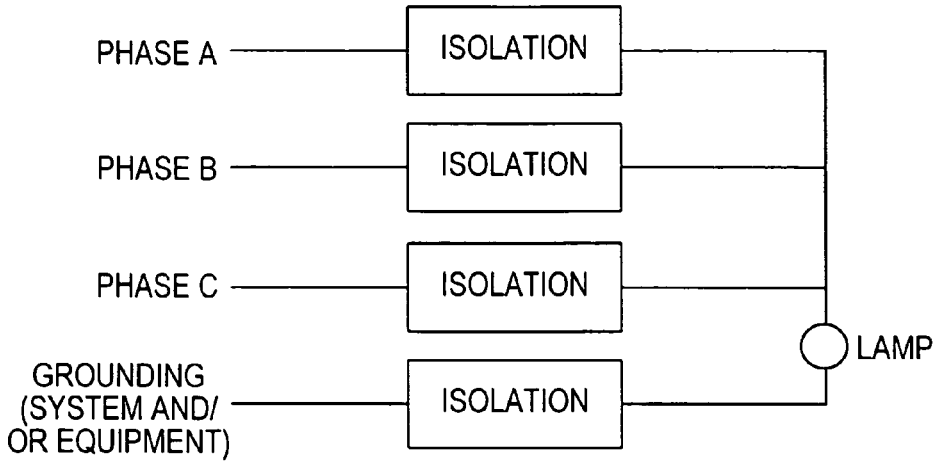
FIG. 23 shows an isolated block diagram.
Figure 24:
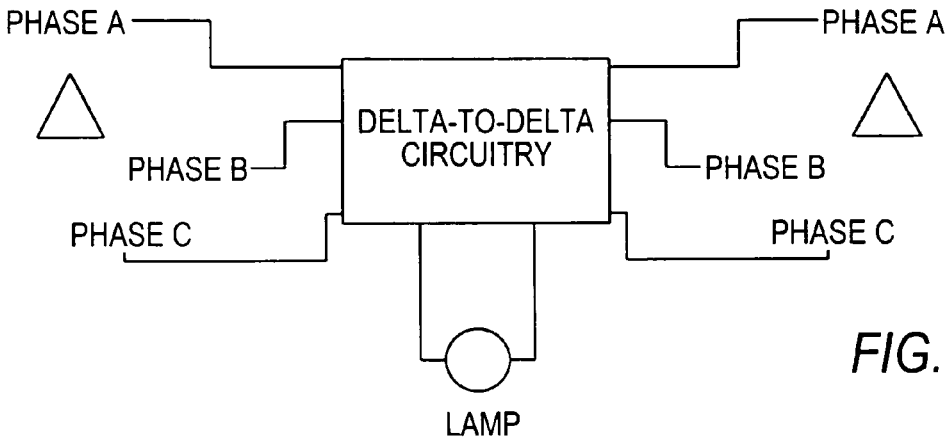
FIG. 24 shows a delta-to-delta isolated and/or non-isolated block diagram.
Figure 25:
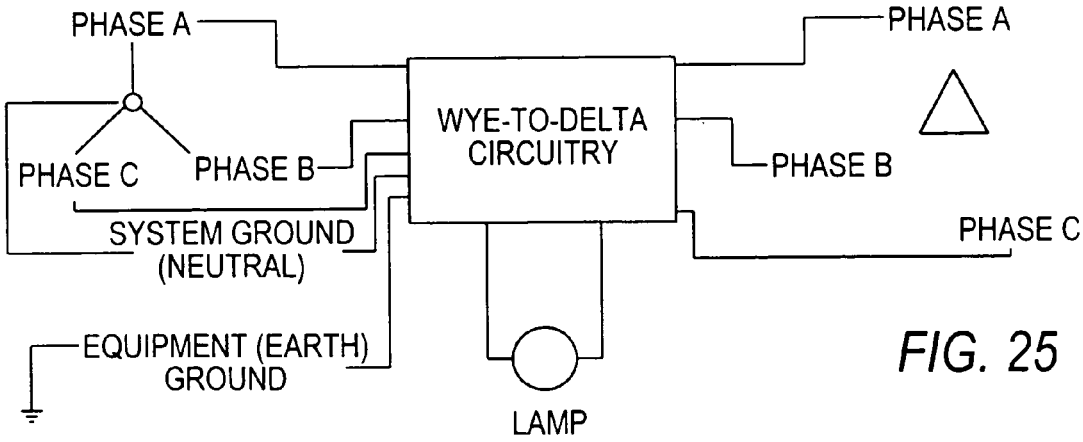
FIG. 25 shows a wye-to-delta isolated and/or non-isolated block diagram.

FIGS. 23–25 show embodiments for detecting and indicating the absence of a phase voltage of a multi-phase circuit on a plug or connector. The detection method can be through the use of isolated as well as circuitry that does not provide isolation from the AC mains. The detection circuit should be of minimum size to permit it to be placed within the husk of a plug or connector. Typically, a circuit that does not provide isolation from the AC mains provide the smallest possible structure for detecting and displaying the absence of a phase of a multi-phase circuit. In the Figs., although the equipment ground is shown as not being connected, it can be configured with an equipment (earth) ground in addition to or instead of a system ground (neutral).

Furthermore, in addition to providing a voltage indication in the event of a missing phase, the circuit can be adapted to indicate an unbalanced load or excessive equipment ground leakage current.

FIG. 23 is a block diagram of an isolated 3 phase connection where the ground is either the system and/or equipment ground. FIG. 24 is a block diagram of a Delta-to-Delta isolated and/or non-isolated circuit. FIG. 25 is a block diagram of a Wye-to-Delta isolated and/or non-isolated connection with equipment (earth) ground.

Figure 26:
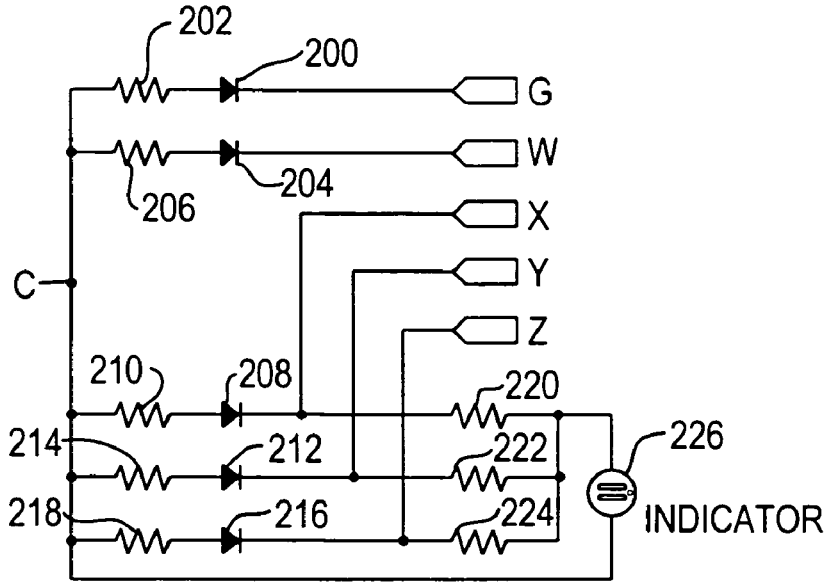
FIGS. 26–29 show non-isolated schematics of various embodiments.

FIG. 26 is a schematic wiring diagram of a non-isolated 3 phase, 3-pole, 3 wire plug or connector. Externally, terminal G is connected to the equipment ground conductor; terminal W is connected to the system ground conductor, and terminals X, Y and Z are connected to X, Y and Z terminals of the plug and/or connector. Internally, terminal G is connected to common terminal C through diode 200 in series with resistor 202 and, terminal W is connected to common terminal C through diode 204 in series with resistor 206. Terminals X, Y and Z are connected through diodes 208, 212 and 216 in series with resistors 210, 214 and 218, respectively to terminal C. Terminals X, Y and Z are also connected through resistors 220, 222 and 224 respectively through indicator 226 to terminal C. The indicator can be an LED, a neon bulb etc.

Continuing with FIG. 26, the various elements are further identified as follows:

Diodes 200, 204, 208, 212 and 216 are SM4007;

Indictor 226 can be NE38/GREEN;

Resistors 202 and 206 can be 900K ohms;

Resistors 210, 214 and 218 can be 240K ohms; and

Resistors 220, 222 and 224 can be 165K ohms.

Figure 27:
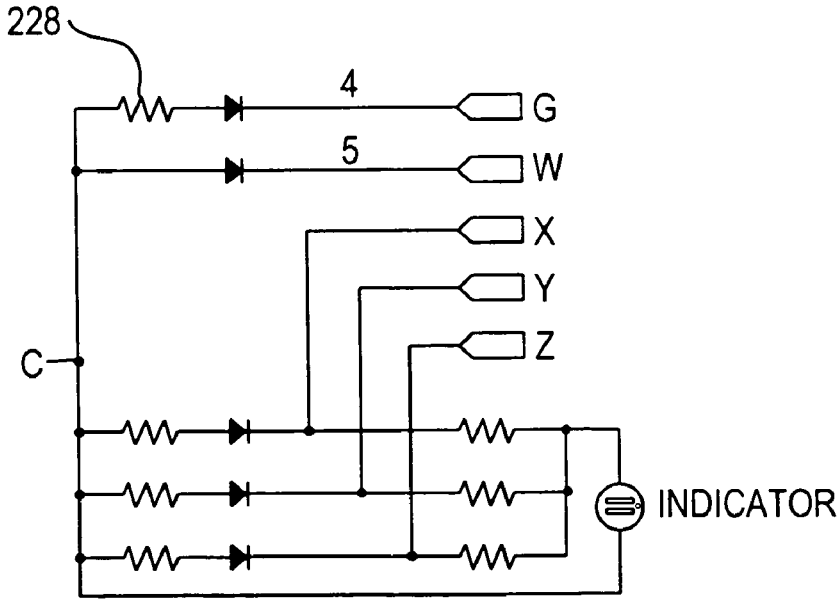

FIG. 27 is a schematic wiring diagram of another embodiment of a non-isolated 3 phase, 3 pole, 3 wire plug and/or connector which, except for the absence of resistor 206, is similar to the schematic wiring diagram of FIG. 26.

Figure 28:
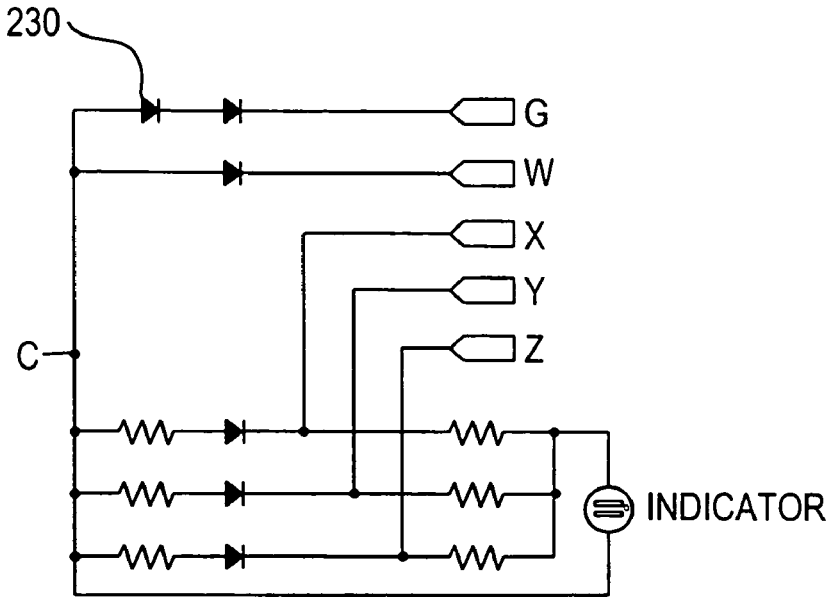

FIG. 28 is a schematic wiring diagram of still another embodiment of a non-isolated 3 phase, 3 pole, 3 wire plug and/or connector which, except for the substitution of diode 230 for the resistor 228 of FIG. 27, is similar to the schematic wiring diagram of FIG. 27.

Figure 29:
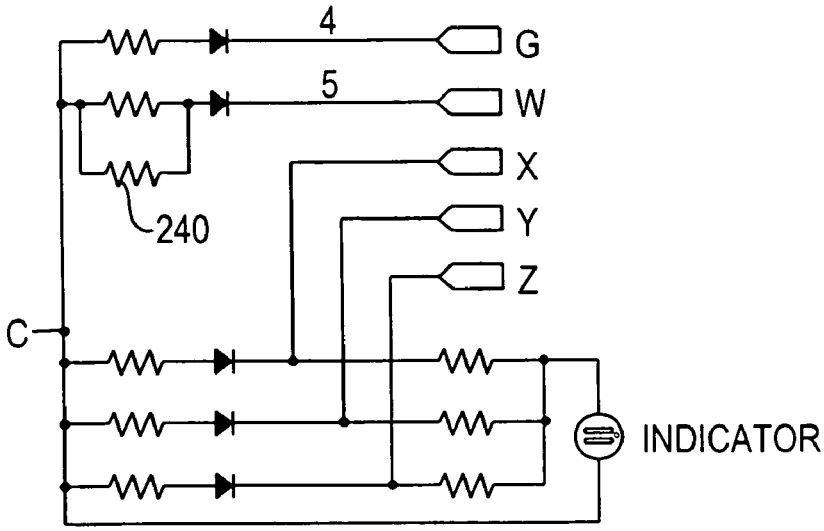

FIG. 29 is a schematic wiring diagram of still another embodiment of a non-isolated 3 phase, 3 pole, 3 wire plug or connector which, except for the addition of resistor 240 connected in parallel with the resistor 206 of the circuit of FIG. 26, is similar to the schematic wiring diagram of FIG. 26. The operational jumper 240, which can be a resistor rheostat, etc., allows for alternate power main configuration such as, for example, Open Delta. It can be employed on any or all phases, ground or neutral conductors.

Referring to the non-isolated schematic wiring diagrams of FIGS. 26–29, the following applies:

One or more resistors can be substituted for the resistors shown to provide high reliability under high voltage or high power dissipation conditions.

Delta connections do not require a system ground, neutral and associated diode-resistor pair.

The system ground, neutral and equipment, earth ground resistors can be shorted without effecting the operation of the circuits.

All diode cathode and anodes connections may be reversed.

The circuit is balanced through resistor value selection such that the neon bulb is illuminated when all phases are present. Under such conditions, the currents in system ground, neutral and/or equipment, earth ground connections are almost non-existent.

Selection of a neon bulb as a light source allows the resistor values to increase while maintaining light source brightness. The neon bulb has two advantages, first, the power dissipations in the resistor elements are reduced because smaller lower wattage resistors are used. Second, the increase in System Ground, Neutral (W)/or Equipment. Earth Ground (G) current created by connecting phases can be controlled to less than 500 microamperes RMS by using the higher resister values selected for neon operation.

The circuits of FIGS. 26–29 can provide an indication of

A missing phase or unbalanced load at low system; or

Equipment ground leakage current.

To indicate a missing phase or unbalanced load, the illuminated plug or connector will provide a single indication for three-phase Wye or delta voltage configuration, even when conductors disconnect, or with unbalanced loads. With AC main power ON and all conductors connected, the indicator is ON. Should one or more of the three-phase AC main conductors disconnect, the indicator will remain ON, provided that one of the three-phase AC main conductors and an additional conductor (either another phase, system or equipment ground) for return is present.

With a missing phase or unbalanced load:

The 3-Phase Delta or Wye connector and/or plug does not have system or equipment ground available.

The indicator will be illuminated when all three phases have their respective voltage present.

The indicator will be illuminated with any one phase missing, broken, not connected, etc. and the remaining two phases have their respective voltage present.

The 3-Phase Delta or Wye connected plug and/or connector have System or Equipment ground available and present within the plug and/or connector;

The indicator will be illuminated when all three phases have their respective voltage present as well as either or both system; and, equipment ground available and present.

The indicator will be illuminated when any one phase is missing, broken, not connected, etc and the remaining two-phases have their respective voltage present as well as either or both system and equipment ground available and present.

The indicator will be illuminated with any two phases missing, broken, not connected, etc and the remaining phase has its respective voltage present as well as either or both system and equipment ground available and present.

With equipment ground leakage current:

Under normal operating conditions the illuminated plug or connector circuitry will not exceed 500 microamperes MS leakage current through the illuminated plug or connector to either System and/or Equipment Ground. Thus, with limited excessively tripping ground-fault interrupt devices connected to the AC line.

Figure 30:
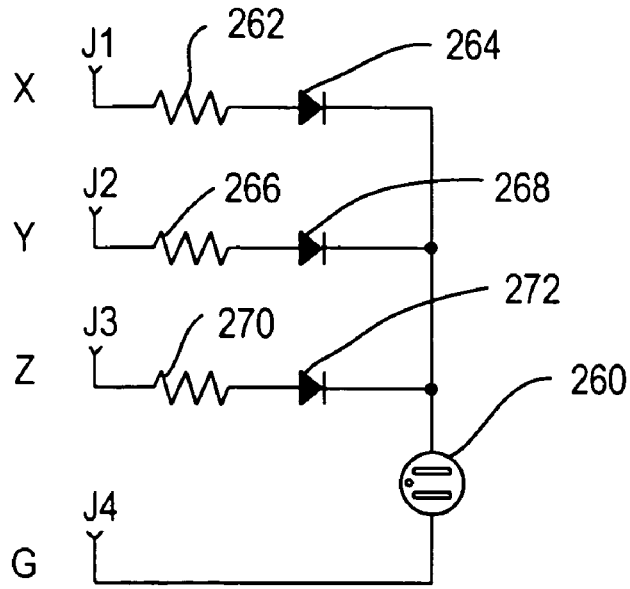
FIGS. 30, 31 show circuits which indicate the presence of ground.

Referring to FIG. 30, there is shown a circuit for a three-phase plug or connector having a GROUND indicator that can purposefully draw current to earth ground.

If there is a good earth ground, the circuit of FIG. 30 can be used separately or in combination with the three-phase plug or connector of FIGS. 26–29 and can be made to illuminate with the same or a different color indicator as the 3 phase indicator of FIGS. 26–29. The ground indicator circuit of FIG. 30 can be configured to provide the following:

Neon or LED indicator ON when there is a good ground connection;

Flash LED if leaking to ground;

Flash LED if lose earth ground;

A Power Light indicator (or single phase device indicator) purposefully ON with power applied, drawing current with either a neutral or earth failure. The back-to-back diodes present minimal current between earth and neutral, but strongly favor neutral as the preferred current path.

Additionally functionality may be employed including:

Illuminate (different or same color, flash, etc.) the earth ground indicator based upon whether it is a good ground, high impedance earth ground, grounded neutral, etc.

Determine if connection is to an isolated ground source or not.

Perform all functions the plug-in checkers do, i.e., wiring connections interchanged, missing phases, etc.

Leakage current to earth ground is low for neons. For LEDs, the rms leakage current is low for a pulsed operation.

Referring to FIG. 30, there is shown a single light source which indicates the presence of a ground. In FIG. 30, the X, Y and Z terminals of the plug or connector are each connected through a separate resistor in series with a diode where resistors 262, 266 and 270 are coupled in series with diodes 264, 268 and 272 respectively and to a terminal of an indicator means 260 such as a neon bulb. The other terminal of the neon bulb is connected to equipment ground terminal G.

Figure 31:
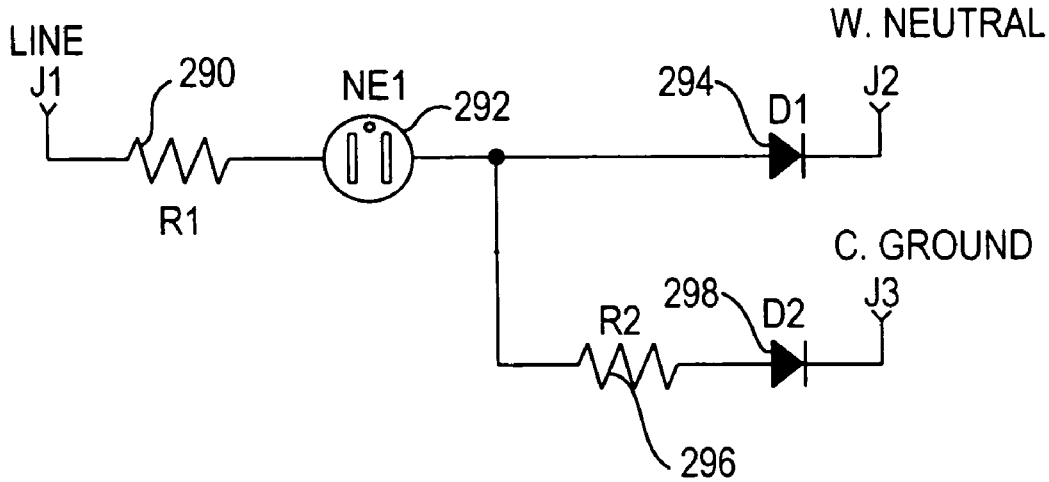

Referring to FIG. 31, there is shown a single phase indicator constructed to favor neutral as the return path. The line terminal J1 is connected to the neutral terminal J2 through resistor 290, indicator 292 which can be a neon bulb, and diode 294, all of which are connected in series. The junction between the indicator 292 and the diode 294 is connected to the ground J3 through resistor 296 in series with diode 298. The elements of FIG. 31 are further identified as follows:

Resistor 290 is 100K ohms;

Resistor 296 is 20K ohms;

Diodes 294 and 298 are SM4007; and

Indicator 292 is NE38/GRE.

Referring to the schematic wiring diagrams of FIGS. 26–29, the following pertains:

One or more resistors may replace the resistors shown to provide high reliability under high voltage or high power dissipation conditions.

Delta connections do not require a system ground, neutral and associated diode-resistor pair.

The system ground, neutral and equipment, and earth ground resistors may be shorted without effecting operation.

Connection to system ground, neutral and/or equipment, and earth ground is optional.

All diode cathode and anodes connections may be reversed.

The circuit is balanced through resistor value selection such that the neon illuminates when all phases are present. Under such conditions, the currents in system ground, neutral and/or equipment, and earth ground connections are almost non-existent.

Selection of neon as a light source allows the resistor values to increase while maintaining light source brightness. Neon selection has two advantages. First, the power dissipations in the resistor elements are reduced; smaller lower wattage resistors are used. Second, the increase in system ground, neutral or equipment, and earth ground current created by connecting phases can be controlled to less than 500 microamperes RMS by using higher register values selected for neon operation.

FIGS. 27 and 28 show alternative configuration that further lower equipment, earth ground leakage current. The majority of the leakage current is directed to system ground and neutral.

FIG. 32 is a typical logic table for the embodiments of FIGS. 26–29. In the logic table, the following is noted:

"X" indicates conductor connected to phase and/or ground at the connector/plug indicating the presence of a voltage.

The presence of voltage for the situations that only have one connection only has meaning if there is a return path, else it is floating (Line numbers 8, 16, 21, 22 and 23).

All other connections without an "X" are open and not connected to the source location.

Equipment ground is only wired/connected if no system ground is available for connection. In this situation the above table is valid where the system ground is replaced by equipment ground. All rows marked with and without an "X" still holds for the associated lamp state(s). In this application system, ground is often referred to as neutral.

While there have been shown and described and pointed out the fundamental novel features of the invention as applied to the preferred embodiments, it will be understood that various omissions and substitutions and changes of the form and details of the structures and circuits illustrated and in their operation may be made by those skilled in the art without departing from the spirit of the invention.

What is claimed is:

1. Apparatus adapted to be coupled to an AC multi-phase power line having a first conductor for receiving a first phase, a second conductor for receiving a second phase, a third conductor for receiving a third phase and a fourth conductor for a ground connection comprising:

a first series circuit of a diode interposed between a first resistor and a second resistor;

a second series circuit of a diode interposed between a first resistor and a second resistor;

a third circuit of a diode interposed between a first resistor and a second resistor; said first, second and third series circuits coupled in parallel with each other between a first end terminal coupled to the first resistor of each series circuit and a second end terminal coupled to the second resistor of each series circuit;

indicator means coupled between said first and second end terminals;

a first diode having a first terminal coupled to said first end terminal and a second terminal adapted to be coupled to said fourth conductor;

said first conductor for receiving said first phase is coupled between said diode and said second resistor of said first series circuit;

said second conductor for receiving said second phase is coupled between said diode and said second resistor of said second series circuit; and said third conductor for receiving said third phase is coupled between said diode and said second resistor of said third series circuit.

2. The apparatus or claim 1 wherein said fourth conductor is an equipment ground.

3. The apparatus of claim 2 wherein said AC multi-phase power line is coupled to a delta connected source of power.

4. The apparatus of claim 2 wherein said indicator means is an LED.

5. The apparatus of claim 2 wherein said indicator means is a neon bulb.

6. The apparatus of claim 2 further comprising a resistor coupled in series with said first diode adapted to be coupled to said fourth conductor.

7. The apparatus of claim 6 further comprising:

a fourth circuit of a resistor in series with a diode having one end of said fourth series circuit coupled to said first end terminal and the other end adapted to be coupled to an equipment ground conductor.

8. The apparatus of claim 2 further comprising:

a second diode having a first terminal coupled to said first end terminal and a second terminal adapted to be coupled to a system ground conductor.

9. The apparatus of claim 8 further comprising a resistor coupled in series with said first diode.

10. The apparatus of claim 9 further comprising a resistor coupled in series with said second diode.

11. The apparatus of claim 1 wherein said indicator means is located within a connector and positioned to allow light generated by said indicator means to exit said connector.

12. The apparatus of claim 11 wherein said indicator means is located adjacent to a window in said connector.

13. The apparatus of claim 11 wherein light generated by said indicator means is coupled via a light pipe to a window in said connector.

* * * * *